United States Patent [19]

Kisler

[11] Patent Number: 4,462,528

[45] Date of Patent: Jul. 31, 1984

[54] ELECTROSTATIC WEB CLAMP

[75] Inventor: Semyon Kisler, West Newton, Mass.

[73] Assignee: Polaroid Corporation, Cambridge, Mass.

[21] Appl. No.: 389,862

[22] Filed: Jun. 18, 1982

[51] Int. Cl.[3] ..... B65H 17/26; B65H 17/28

[52] U.S. Cl. ..... 226/120; 198/691; 226/94

[58] Field of Search ..... 226/120, 4, 8, 50, 94, 226/195, 38; 198/690, 691; 271/18.1, 193; 118/33; 83/451, 452; 209/904, 907; 242/147 R, 147 M, 75

[56] References Cited

U.S. PATENT DOCUMENTS

| | | | |
|---|---|---|---|
| Re. 26,951 | 9/1970 | Vaccaro | 226/94 X |
| 2,831,678 | 4/1958 | MacNeill | 226/50 |
| 3,082,735 | 3/1963 | Vaccaro | 118/33 |
| 3,323,794 | 6/1967 | Brandt | 226/94 X |
| 3,493,157 | 2/1970 | Burdorf et al. | 226/94 |

*Primary Examiner*—Leonard D. Christian
*Attorney, Agent, or Firm*—John J. Kelleher

[57] ABSTRACT

An electrostatic field equal to or greater than a predetermined magnitude is established between the ends of a multiplicity of conductive bristles and a stationary conductive reference surface spaced from the end of the bristles for the puspose of rapidly arresting and/or preventing movement of insulative material having a portion thereof located in the electrostatic field established between the bristle ends and the reference surface and subsequently releasing the material by applying a voltage of opposite polarity to neutralize the force of the electrostatic field, arresting movement of the material.

25 Claims, 4 Drawing Figures

ELECTROSTATIC WEB CLAMP

BACKGROUND OF THE INVENTION

The present invention relates to apparatus for rapidly arresting or precluding movement of insulative material in general, and to such apparatus for electrostatically clamping a portion of a continuous web of such material, in particular.

In a coating machine or product assembly machines for assembling insulative (dielectric or semiconductive) material into a finished product, for example, it is often necessary to intermittently arrest the movement of a web of such material, for any number of reasons, for various periods of time. Web motion may be interrupted so that an additional roll of insulative material may be added to the coating machine, a particular assembly operation can be performed on a portion of the moving web at a particular assembly machine workstation, to remedy an unpredictable machine failure or for the performance of routine periodic machine maintenance.

In web coating machines it is extremely important that the tension of web materials being coated in such machines remain fairly constant at all times, including that period of time when web movement is interrupted, in order to avoid changes in web speed during the start-up period when web movement is subsequently re-initiated. Failure to maintain a constant tension level on a web being coated with coating materials flowing at a constant or fixed rate onto a web moving at a varying rate will cause variations in coating thickness that may render the coated web unacceptable for subsequent use in a finished product.

In a product assembly machine for assembling web material into a finished product in which the web has previously had relatively large openings cut therein and these openings are subsequently moved into an assembly machine workstation for the purpose of having an assembly operation performed thereon, web portions adjacent said previously cut openings will often move slightly or develop wrinkles therein because of the web tensioning forces being distributed across a web of reduced cross section. Such novement or wrinkling of the web may cause registration problems or workstation to web misalignment that could substantially reduce the ability of the assembly machine to properly assemble or process the web into a finished product.

In addition to the above, numerous other situations occur where it is either necessary or desirable to be able to rapidly clamp or arrest the motion of insulative materials for various periods of time. Conventional means for handling the above-mentioned problems have been employed with varying degrees of success. Mechanical-type clamping appartus has been ineffective in the control of web tension primarily because of the relatively long times required to apply a clamping force to a lengthy web with such apparatus. It is at least theoretically possible to employ a corona field for insulative web clamping purposes. However, such clamping apparatus would also require extremely long clamping times because of the time required to produce the corona field. The longer the clamping times the greater may be the variation in web tension. Additional disadvantages associated with applying a mechanical clamp to selected portions of a web in a product assembly machine are the relatively large and complex clamping mechanisms that are normally required to properly clamp such selected web portions.

It is a principal object of the present invention to provide apparatus for applying a clamping force to an insulative material within an extremely short period of time.

It is another object of the present invention to provide apparatus that can readily clamp selected portions of an insulative material.

It is a further object of the present invention to provide apparatus for arresting and/or temporarily preventing movement of a continuous web of insulative material.

Other objects as well as features and advantages of the present invention will be readily apparent from the following detailed description of the preferred embodiment thereof taken in conjunction with the accompanying drawings.

SUMMARY

In accordance with the present invention apparatus is provided for rapidly arresting or precluding the movement of insulative material for selected periods of time. The apparatus includes a stationary conductive reference surface and a multiplicity of generally parallel extending conductive bristles having free ends thereof physically spaced from said reference surface and having a controlled DC voltage source connected between said reference surface and said conductive bristles. An electrostatic field of a predetermined magnitude established between said bristle ends and said reference surface produced by said apparatus provides a force between said material and said reference surface that thereby precludes or rapidly arrests the movement of insulative material located between said bristle ends and reference surface.

DESCRIPTION OF THE PREFERRED EMBODIMENTS

Figures 1A, 1B:
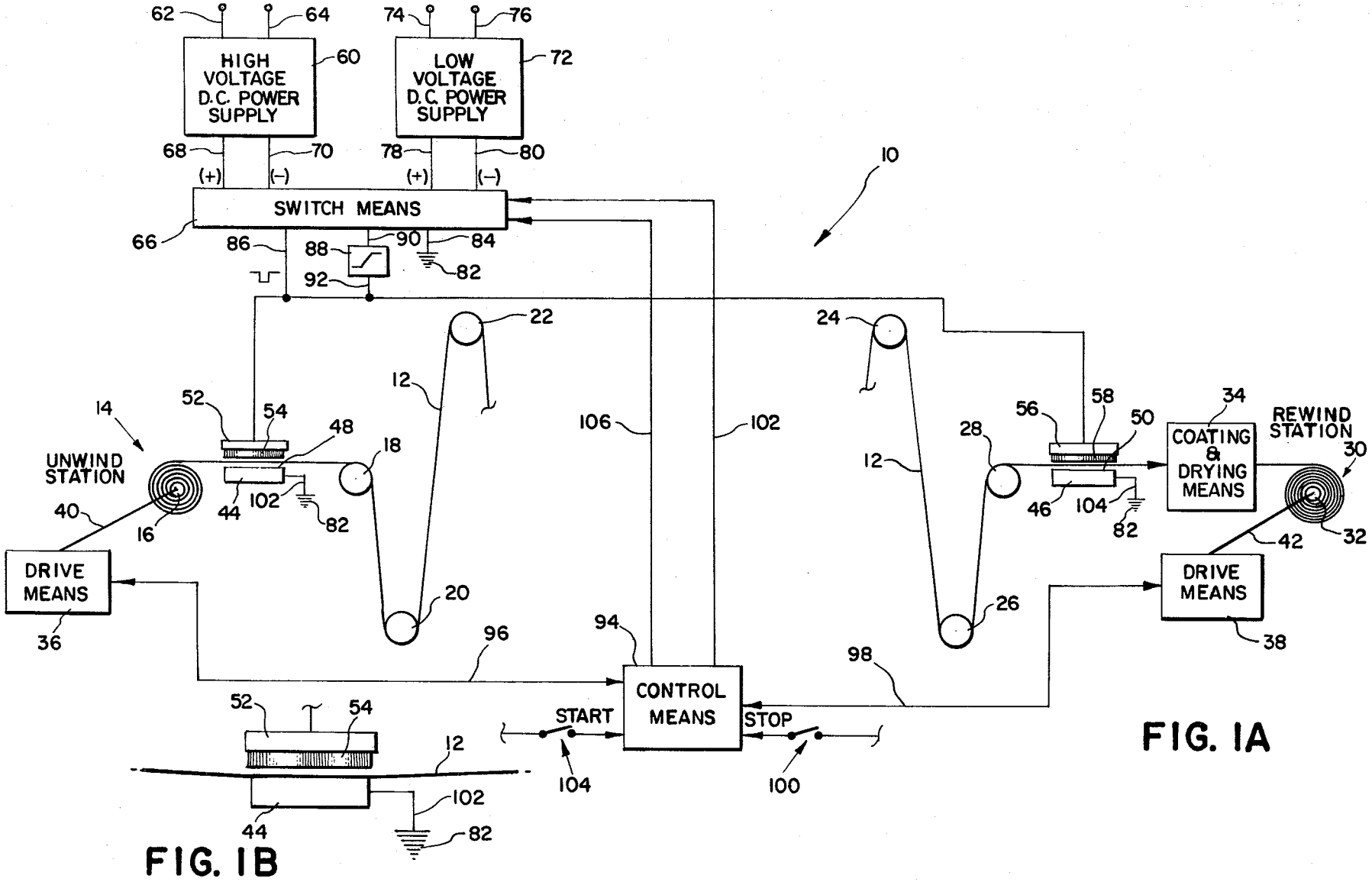
FIG. 1A is a schematic diagram of a web coating system employing the electrostatic clamping apparatus of the present invention.
FIG. 1B is an enlarged detail of a portion of the electrostatic clamping apparatus depicted in FIG. 1A showing said clamping apparatus in an energized or web clamping state.

Turning now to the drawings, in FIG. 1A a schematic diagram of web coating system 10 incorporating a preferred embodiment of the electrostatic clamping apparatus of the present invention, is depicted. In FIG. 1A insulative web 12, constructed of a polyester based material 5 mils thick, was previously wound into roll 14 and then placed on rotatably mounted unwind mandrel 16, in a conventional manner, for rotation therewith. Web 12, in excess of several thousand feet in length, passes over a series of rotatably mounted support rollers 18, 20, 22 . . . 24, 26, 28 with the free end of said web 12 forming roll 30. Roll 30, is, in turn, mounted in a conventional manner on rotatably mounted rewind mandrel 32, for rotation therewith. Insulative web 12 is driven from roll 14 over support rollers 18-28 through coating and drying means 34 and then onto roll 30 by the combination of drive means 36 and 38 which are mechanically coupled to said rolls 14, 30 thru shafts 40 and 42, respectively.

In a web coating system of the type schematically described in FIG. 1A it is fairly common practice to have extremely long web lengths between web unwind and rewind mandrels or stations. In such coating systems the amount of web contained between unwind and rewind stations may exceed 2 miles in length. A sudden reduction in web tension, for example, in a web of this length can produce considerable slack or a substantial increase in web length between these two stations. If the driving force moving web 12 through coating and driving apparatus 34 between unwind and rewind stations should suddenly be reduced or interrupted, web tension will be reduced unless means are provided to minimize or prevent such a web tension change. Failure to maintain web tension at a particular level or within a particular range of tension levels in web coating apparatus may produce substantial variations in web speed when a drive force is subsequently applied to a stationary untensioned web for web movement and coating purposes. Coating materials flowing at a fixed rate onto a web moving at a varying rate of speed may produce variations in web coating thickness that will render substantial lengths of the coated web unsuitable for subsequent use in a finished product.

Prior attempts at controlling web tension with mechanical clamping apparatus have thus far proved to be unsatisfactory. In addition to the complex mechanical mechanisms that would be required to produce a satisfactory web clamp, a relatively large amount of time would be consumed between the initial actuation and the subsequent application of a mechanical clamping force to a lengthy tensioned web. The greater the period of time between web driving force interruption and web clamping force application the greater may be the change in web tension. The electrostatic clamping apparatus of the present invention both avoids the complexities of a mechanical clamping arrangement and is able to apply a clamping force to an insulative web, for example, substantially faster than a mechanical clamping arrangement. A preferred embodiment of the electrostatic clamping apparatus of the present invention is incorporated in the web coating apparatus shown in FIG. 1A, clamping apparatus that is described in detail below.

With continuing reference to FIG. 1A, the electrostatic clamping apparatus of the present invention includes electrically conductive plates 44 and 46 that are mounted in a fixed position with each of said plates having flat or planar reference surfaces 48 and 50, respectively, located immediately adjacent but spaced from a surface of insulative web 12. Fixedly mounted conductive bristle brush 52 having stainless steel bristles 54 projecting therefrom has the free ends of said bristles adjacent but spaced from that surface of web 12 opposite that surface portion of said web 12 that is adjacent conductive plate 44. Similarly, conductive bristle brush 56 having stainless bristles 58 projecting therefrom has the free ends of said bristles adjacent but spaced from that surface of web 12 opposite that surface portion of said web 12 that is adjacent conductive plate 46.

The bristles or filaments of electrostatic field producing brushes 52 and 56 are preferably formed of a highly conductive metal such as stainless steel or the like with the long dimension or axis of each brush bristle being preferably oriented at right angles to the adjacent surface of the insulative material to be clamped. Brushes 52 and 56 normally have a bristle or filament density in excess of 120 K filaments per square inch and preferably in excess of 150 K filaments per square inch. The smallest diameter possible for a bristle for use in an electrostatic field producing brush such as brushes 52 or 56 appears to be in the vicinity of one micron. Bristles having a diameter of 50 microns or less are particularly useful in electrostatic clamping apparatus of type disclosed herein. In this preferred embodiment of the present invention brush bristles having a diameter of 4 microns have been effectively employed in brushes 52 and 56.

Relatively high voltage DC power supply 66 connected to a suitable source of electrical energy (not shown) through paths 62, 64 has its DC output terminals connected to switch means 66 through paths 68, 70. Similarly, relatively low voltage power supply 72 (low relative to power supply 60) connected to a suitable source of electrical energy (not shown) through paths 74, 76, has its DC output terminals connected to said switch means 66 through paths 78, 80. Switch means 66 is a conventional switching device that may include any number of conventional solid state and/or electromechanical switching components to provide the switching functions to be described elsewhere herein. One output of switch means 66 is connected to system ground 82 through path 84. Another output of switch means 66 is connected to the electrically conductive bristles of brushes 52, 56 through path 86 and the remaining output of said switch means 66 is connected to conventional delay network 88 through path 90. The output of delay network 88 is, in turn, connected to the electrically conductive bristles of brushes 52 and 56, through path 92.

In operation web 12 is driven by drive means 36, 38 through web coating and drying means or stations 34 for web 12 coating purposes in response to control signals from control means 94 transmitted through paths 96 and 98, respectively. If drive means 36, 38 should be de-energized for any reason such as by the manual actuation of stop switch 100, by safety apparatus that automatically shuts down the coating machine, as a result of electrical power failure, etc., or if control means 94 senses an unacceptable reduction in the speed of drive means 36 and/or 38 thru said paths 96 and/or 98 and a corresponding reduction in web tension as determined by conventional speed sensors (not shown) located within said drive means 36 and 38, conventional control means 94 would transmit an electrostatic web-clamping signal to switch means 66 through path 102. Upon receipt of a clamping signal from control means 94 switch means 66 would cause the output of high voltage power supply 60 to be gradually applied, at a predetermined rate, between conductive bristle brushes 52, 56 and their associated conductive reference surfaces 48, 50. This is accomplished in the following manner. When a clamping signal is received from control means 94, switch means 66 connects the negative terminal of high voltage power supply 60 to system ground 82 through path 70, 84 and to conductive reference surfaces 48, 50 which are connected to said system ground 82 through paths 102 and 104, respectively. Simultaneously therewith the positive terminal of said power supply 60 is gradually connected to conductive bristle brushes 52, 56 through conventional delay network 88. For 5 mil thick, 60 inch wide polyester based web 12, it was determined that an ultimate voltage of approximately 1000 VDC would adequately arrest the motion of said web 12. With the output of power supply 60 being so connected a relatively intense electrostatic field is established between brushes 52, 56 and their associated reference surfaces 48, 50 causing the motion of those portions of web 12 positioned between said brushes and surfaces to be rapidly arrested.

An electrostatic field can be produced in a few nanoseconds between brush 52 and surface 44, for example, if the output of power supply 60 were to be suddenly applied between these two components. However, the function of delay network 88 is to cause a gradual build-up of the web-motion-retarding electrostatic field produced between brushes 52, 56 and associated surfaces 48, 50 to avoid applying an excessive amount of web 12 stressing and/or breaking force. The rate at which delay network 88 applies an electrostatic field producing potential between brushes 52, 56 and associated surfaces 44, 46, is primarily determined by the web material. Normally, the stronger (less deformable) the material the faster may be the application of a web-motion retarding force. For polyester based web 12 the web clamping voltage was applied at a linearly increasing rate over a period of approximately one (1) second until the full 1000 VDC was established between brushes 52, 56 and their associated conductive reference surfaces 48, 50.

When an electrostatic clamping force is applied to a web such as web 12 by brushes 52, 56, a substantial portion of this clamping force often remains even after the voltage supplied by power supply 60 is removed from said brushes 52, 56 because of the relatively long duration dipole or polarization charge that is placed on a polyester based web 12 by conductive bristle brushes employed in the manner disclosed. In order to effectively remove this residual, unwanted clamping force a reverse polarity electrostatic field having a predetermined reduced magnitude is applied to these electrostatically charged web 12 portions before movement of a previously clamped web is subsequently initiated. This may be accomplished in the following manner. In FIG. 1A, a web 12 movement sequence is initiated by manually closing stop switch 104 which causes an appropriate start signal to be applied, from a suitable signal source (not shown), to control means 94. Upon receipt of this start signal, control means 94 transmits a web 12 unclamping signal to switch means 66 through path 106, and switch means 66, in turn, causes relatively high voltage power supply 60 (high with respect to power supply 72) to be disconnected from electrostatic field producing brushes 52, 56 and from associated grounded reference surfaces 48, 50. Simultaneously therewith and subsequent thereto, switch means 66 also causes the output of relatively low voltage power supply 72 to be momentarily (milliseconds) applied between said brushes 52, 56 and said associated grounded reference surfaces 48, 50. When the DC output of power supply 72 is connected between brushes 52, 56 and surfaces 48, 50 the negative terminal of power supply 72 is rapidly connected to said brushes 52, 56 through path 80 and 86 and the positive terminal of said power supply 72 is rapidly connected to reference surfaces 48, 50 through path 78, 84 and common ground 82. It should be noted that if extremely low or non-dielectric materials (such as paper based materials or the like) are to be clamped there may not be a residual dipole charge on the web and therefore a reverse polarity electrostatic field and corresponding voltage would not be required in order to remove all of the previously applied web clamp.

The polarity of the voltage supplied by relatively low voltage power supply 72 is always the reverse of that supplied by relatively high voltage power supply 60. It is initially a matter of design choice as to whether a positive or negative high voltage is employed for electrostatic clamping purposes if there is no initial charge on the web to be clamped. If web 12 or any such insulative material should have an initial polarization or dipole charge thereon, the polarity of the potential applied to brushes 52 and 56 must be opposite to the polarity of said initial charge. Once a particular polarity has been chosen a polarity opposite to that initially chosen polarity must be employed for proper web unclamping purposes. When the initial polarity is selected and employed, web 12 is electrostatically clamped by being electrostatically attracted to grounded surfaces 48, 50. When a voltage of a polarity opposite to said initial polarity is subsequently applied between brushes 52, 56 and associated surfaces 48, 50, web 12 is unclamped by being electrostatically repulsed from said surfaces 48, 50. As mentioned above it has been determined that a voltage of 1000 VDC between brushes 52, 56 and associated surfaces 48, 50 will adequately arrest the motion of or clamp 5 mil polyester based web 12. It has also been determined that an opposite polarity voltage of approximately 460–470 VDC for a few milliseconds will release or un-clamp said web 12 from said surfaces 44, 46 rapidly enough to avoid interference with any subsequent web movement.

The primary purpose of the reverse polarity voltage is to overcome a force of attraction between web 12 and surfaces 48, 50. If the reverse voltage magnitude is too small the residual force of attraction will not be completely overcome. However, if the magnitude of the reverse polarity voltage is too large as it would be for example in the apparatus of FIG. 1A if it approached or exceeded 1000 VDC, web 12 would again become electrostatically clamped to surfaces 48, 50 even though the polarity of the clamping voltage is reversed. Also, in FIG. 1A power supplies 60 and 72 have been shown as two separate voltage sources or power supplies of different voltage magnitudes for convenience only. A single power supply having more than one output voltage whose voltage polarities are reversible with respect to one another may also be employed in the electrostatic web clamping apparatus of FIG. 1A.

Figure 2A:
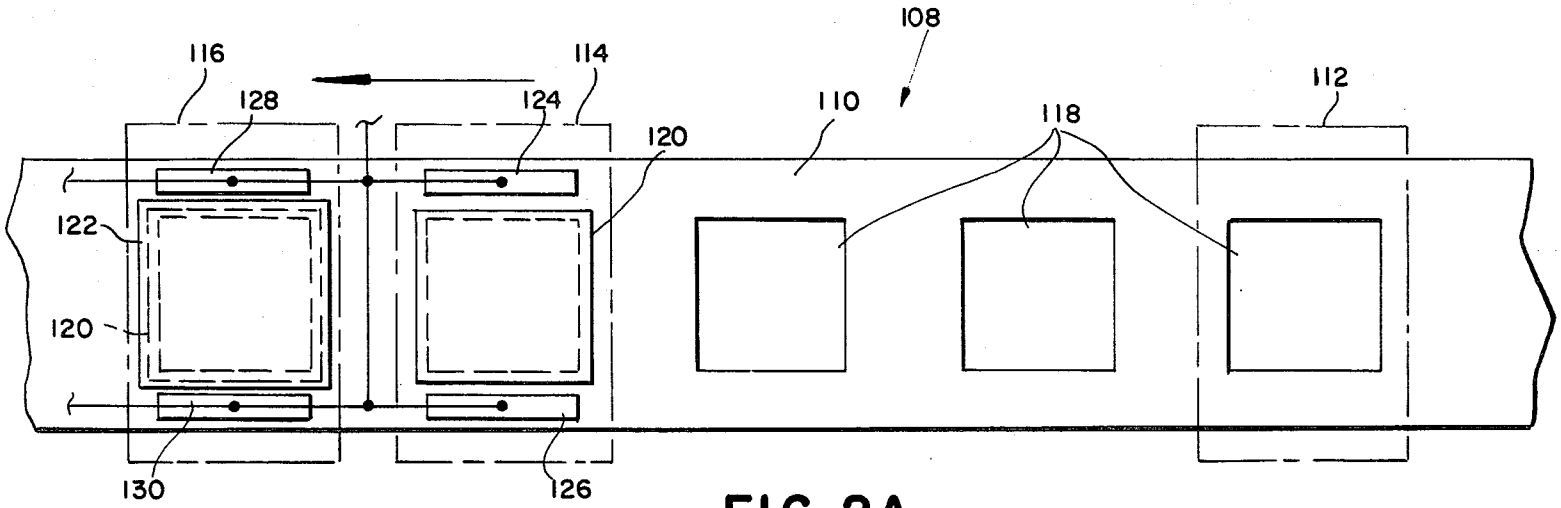
FIG. 2A is a schematic diagram of a top view of a web of material being sequentially moved through and electrostatically clamped at a plurality of assembly machine workstations.
Figure 2B:
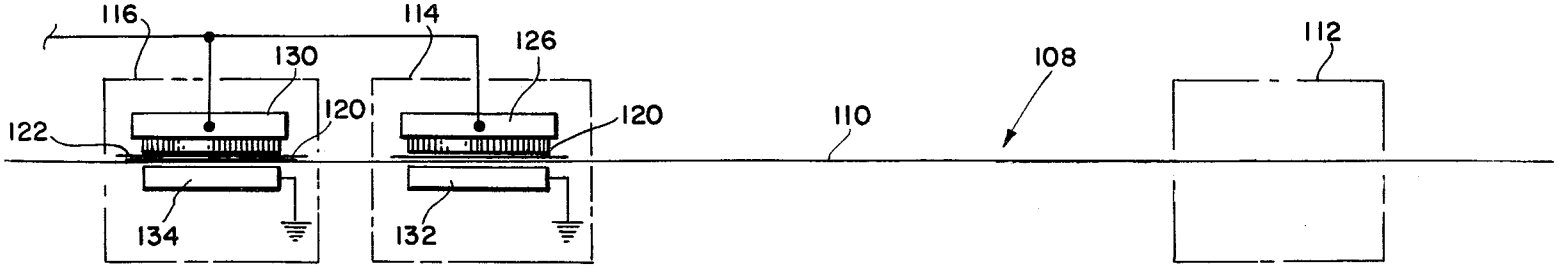
FIG. 2B is an elevational view of the web material and of the electrostatic clamping apparatus depicted in FIG. 2A.

Another preferred embodiment of the present invention is schematically shown in drawing FIGS. 2A and 2B. Whereas the above-described embodiment of the present invention is employed in the web coating apparatus schematically depicted in FIGS. 1A and 1B, this embodiment is employed in photographic film assembly machine 108, a portion of which is schematically shown in said drawing FIGS. 2A and 2B. With the exception of coating and drying means 34, the physical placement of brushes 52, 56 and their associated reference surfaces and the means for initiating and stopping movement of web 12, the electrostatic web clamping technique employed in the web coating and drying apparatus of FIGS. 1A and 1B operates in essentially the same manner as it does in film assembly machine 108 that is shown, in part, in drawing FIGS. 2A and 2B. FIG. 2A is a top view of a web of 3 mil thick, polyester based material 110 having portions thereof that are being intermittently moved through a series of workstations 112, 114, 116, etc., for film assembly purposes. Any number of conventional means presently exist for precisely positioning selected portions of a web within a particular workstation. These positioning means normally generate web start and stop signals which in the control system depicted in FIG. 1A would be substituted for web movement start and stop switches 100 and 104.

Referring again to FIGS. 2A and 2B, as previously mentioned portions of web 110 are moved through a succession of workstations for film assembly purposes. At workstation 112 a series of spaced-apart rectangular openings are cut in web 110 as portions of said web 110 are intermittently moved into and then out of said workstation 112. At workstations 114 and 116 additional layers of material 120, 122, respectively, are subsequently placed over and in registration with said spaced-apart web openings and are also fixedly attached to said web 110. As noted above conventional control means are provided for precisely positioning a web opening to and temporarily stopping same at a series of workstations so that said material layers may be properly placed thereon. However, when a web portion is positioned to a workstation for film assembly purposes there is often a tendency for the web to move slightly with respect to the workstation which can result in an improper web-opening to material-layer registration unless means are provided to prevent such unwanted relative movement. Prior movement preventing arrangements include mechanical clamping apparatus which tended to be slow in clamping, were relatively large and complex and were relatively costly to construct. In assembly machine apparatus 108 partially illustrated in FIGS. 2A and 2B, electrostatic web clamping apparatus is employed instead of mechanical clamping to prevent unwanted web to workstation movement and to thereby prevent the web opening to material-layer registration problem mentioned above. In workstation 114 of assembly machine 108 conductive bristle brushes 124, 126 are positioned along the outer edges of web 110 with the long dimension of their bristles being oriented at approximately right angles to and their free ends being spaced from one surface of said web 110. Similarly, in workstation 116 of assembly machine 108 conductive bristle brushes 128, 130 are also positioned along the outer edges of web 110 with their long dimensions being oriented at approximately right angles to and their free ends being spaced from a surface of said web 110. Brushes 124, 126, 128 and 130 are positioned such that they do not interfere with the assembly process.

Each conductive bristle brush has an electrically conductive reference member associated therewith that is positioned adjacent web 110 and adjacent a web surface that is opposite from that surface adjacent its associated conductive bristle brush. For example, in FIG. 2B, conductive reference member 132 is immediately adjacent that surface of 110 that is opposite the surface of web 110 immediately adjacent its associated conductive bristle brush 126. Similarly, in said FIG. 2B conductive reference member 134 is immediately adjacent that surface of web 110 opposite the surface of web 110 immediately adjacent its associated conductive bristle brush 130.

When a stop signal is applied to the web 110 movement control system such as when a stop signal is applied to control means 94 in FIG. 1A, the voltage from the output of a suitable DC power supply (not shown) is directly connected between commonly connected brushes 124, 126, 128 and 130 and their associated conductive reference members 132, 134, etc. (only two of four shown) opposite said conductive bristle brushes. A voltage of approximately 1000 VDC between said brushes and said reference members will provide an electrostatic field between these sets of components that will adequately clamp workstation portions of web 108 to a planar surface of these reference members. There is no need to delay the application of a voltage to the brushes and their associated reference members because web motion within a workstation is fully arrested before the electrostatic clamp is applied and therefore there is no risk of physical damage to the web.

In a manner similar to that employed in the web coating system of FIG. 1A, after an assembly operation has been performed on a portion of web 108 within a particular workstation a reduced magnitude voltage having a polarity that is opposite to that of the voltage that initially produced the electrostatic web clamping force is applied between commonly connected brushes 124, 126, 128 and 130 and their associated reference members to neutralize any residual clamping force remaining between said web 108 and any of said reference members, before web motion is subsequently initiated. As in the coating apparatus of FIG. 1A it has been determined that a reverse voltage magnitude of from 460 to 470 VDC will adequately neutralize any residual clamping force on web 108 previously produced by the 1000 VDC electrostatic field-producing conductive bristle brushes described above. As in the web coating apparatus of FIG. 1A either two separate power supplies may be employed or a single power supply having the required two different output voltages whose voltage polarities can readily be reversed with respect to one another.

The electrostatic clamping apparatus of the present invention can be adapted to provide a clamping force or forces at any number of locations within product assembly machine 108. Conductive bristle brushes can be constructed such that clamping forces may be supplied to a number of web areas having a variety of shapes. The magnitude of the clamping force is infinitely variable over a broad range of clamping forces, it being directly related to brush-to-reference member voltage magnitude. The maximum rate at which a clamping force may be applied to an insulated material is limited only by the speed of the switching means (such as means 66 in FIG. 1A) employed to apply a voltage to the electrostatic clamp producing conductive bristle brushes and reference members. Obviously, the limit on the lowest rate at which such a clamping force may be applied is infinite.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. Apparatus for clamping insulative material, comprising:

a stationary electrically conductive reference surface adjacent one surface of said material; and a selectively energizeable conductive bristle brush having its free bristle ends adjacent an opposite insulative material surface for establishing a noncorona generated electrostatic field in said material between said free bristle ends and said conductive reference surface to thereby clamp a portion of said insulative material with respect to said reference surface.

2. The apparatus of claim 1 wherein said selectively energizable conductive bristle brush is capable of establishing a dipole charge in said material.

3. The apparatus of claim 2, wherein said insulative material has an initial dipole charge thereon and the polarity of said conductive bristle brush is such that it establishes a subsequent dipole charge in the clamped portion of said material that is opposite in polarity with respect to said intitial dipole charge.

4. The apparatus of claim 1 wherein said material is charge retaining insulative material, and said apparatus additionally includes selectively operative means for neutralizing charges retained in said charge retaining material to effect subsequent release of said material from said reference surface.

5. The apparatus of claim 4 wherein said apparatus includes means for initially establishing an electrostatic field of given polarity to retain said material on said reference surface and for subsequently establishing an electrostatic field of opposite polarity on said material to effect release of said material from said reference surface.

6. The apparatus of claim 1 additionally including drive means for advancing an elongated web of said material along a path extending across said reference surface to facilitate a processing operation, means for sensing termination of advancement of said web, and wherein said apparatus is responsive to said means to establish said electrostatic field to retain on said reference surface the adjoining portion of said web in response to termination of said advancement whereby said web of material is automatically clamped upon any such termination of advancement.

7. The apparatus of claim 1 additionally including drive means for advancing an elongated web of said material while maintaining a given tension therein to facilitate a processing operation, and a pair of said reference surfaces and respective conductive bristle brushes being spaced apart along the path of advancement of said web of material with said conductive bristle brushes being substantially simultaneously operative to establish said electrostatic fields so as to retain spaced apart portions of said web adjoining each of said reference surfaces in clamping arrangement thereto so as to thereby maintain said tension on said web upon any termination of said advancement.

8. The apparatus of claim 7 additionally including means for sensing a reduction in web tension below a given value during said driving operation, and wherein said pair of conductive bristle brushes are responsive to said sensing means to establish their respective fields in response to a reduction in web tension.

9. A method of controlling the position of insulative material ocmprising the steps of:

positioning insulative material between a stationary closely spaced reference surface of conductive material and an electrode arrangement configured when energized for producing a noncorona generated electrostatic field between it and said reference surface; and applying a DC voltage across said electrode arrangement and said reference surface of sufficient magnitude to provide dipole charging of said insulative material located therebetween and thereby arrest relative motion of a portion of said insulative material with respect to said reference surface.

10. The method of claim 9 wherein said DC voltage is applied to said electrode arrangement in a predetermined manner to provide a given voltage rise time to thereby increase the arresting force in a controlled manner.

11. The method of claim 9 additionally including the step of subsequently releasing said material by applying a voltage having DC polarity opposite to that of the first polarity to neutralize any charge retained in said material to thereby facilitate the release of the force maintaining said material in said arrested condition.

12. Apparatus for precluding motion of insulative material, comprising:

a stationary electrically conductive reference surface;

a multiplicity of electrically conductive generally parallel extending bristles having free ends thereof physically spaced from said reference surface; and a first DC voltage source connected between said bristles and said reference surface for establishing a noncorona generated electrostatic field, of predetermined magnitude, between said bristle ends and said reference surface, said electrostatic field producing an electrostatic force that precludes movement of insulative material positioned between said free bristle ends and said reference surface for forces on said material equal to or less than a particular force magnitude.

13. Apparatus for maintaining a particular tension-force level on a selected length of a driven web of insulative material whenever web drive speed is reduced below a predetermined magnitude comprising:

a plurality of stationary, spaced-apart, electrically conductive reference members;

a multiplicity of electrically conductive generally parallel extending bristles having free ends thereof physically spaced from a surface of each of said reference members;

energizeable drive means coupled to said web in a driving relationship;

means for deriving a signal representative of the reduction of the web drive speed below predetermined value that is provided by said drive means; and a first DC voltage source, responsive to said web drive force reduction signal, connected between said bristles and said reference members for establishing a noncorona generated electrostatic field of predetermined magnitude between said bristles and each of said reference surfaces to thereby preclude movement of those portions of said web located between said bristle ends and said reference surfaces and to thereby maintain a particular web tension level on a web-length portion between said spaced-apart reference member whenever web drive force is so reduced.

14. Apparatus for briefly clamping a selected portion of a web of insulative material at an assembly machine workstation, comprising:

energizeable drive means for intermittently driving a portion of said web material into and out of said assembly machine workstation;

an electrically conductive reference member located at said assembly machine workstation;

a multiplicity of electrically conductive generally parallel extending bristles having free ends thereof adjacent a surface of said conductive reference member;

means for deriving a signal representative of the position of a selected portion of said insulative web material; and a first DC voltage source, responsive to said web-portion position signal, connected between said bristles and said reference member for establishing a noncorona generated electrostatic field of predetermined magnitude between said bristles and said reference member surface to thereby electrostatically clamp said selected web material portion to said reference member surface for a predetermined period of time when said portion of said web material is positioned at said assembly machine workstation between said bristles and said reference member.

15. The apparatus of claims 12, 13 or 14 wherein said insulative material has an initial dipole charge thereon and the polarity of the said DC voltage source is such that it establishes a subsequent dipole charge on said insulative material in the clamped portion of said material that is opposite in polarity to said initial dipole charge.

16. The apparatus of claims 12, 13 or 14 further comprising:

a second DC voltage source having a predetermined magnitude that is less than the magnitude of said first DC voltage source; and means for disconnecting said first DC voltage source from between said bristles and said reference surface and subsequently connecting said second DC voltage source momentarily between the same bristles and reference surface such that the voltage polarity of said second voltage source is reversed with respect to said first voltage source when said second voltage source is so connected.

17. The apparatus of claims 12, 13 or 14 wherein said reference surface is planar.

18. The apparatus of claims 12, 13 or 14 wherein said insulative material is attracted to said reference member surface by said electrostatic force and relative motion is thereby precluded between said insulative material and said reference member.

19. The apparatus of claims 12, 13 or 14 wherein said insulative meterial is dielectric.

20. The apparatus of claims 12, 13 or 14 wherein said insulative material is semiconductive.

21. The apparatus of claims 12, 13 or 14 wherein said electrically conductive bristles are formed of stainless steel.

22. The apparatus of claims 12, 13 or 14 wherein the diameter of each electrically conductive bristle is equal to or less than 50 microns.

23. The apparatus of claims 12, 13 or 14 wherein the diameter of each electrically conductive bristle is 4 microns.

24. The apparatus of claim 12, wherein said insulative material is a 5 mil thick polyester based material and the predetermined magnitude of said first DC voltage source is 1000 V.

25. The apparatus of claim 16, wherein said insulative material is a 5 mil thick polyester based material, the predetermined magnitude of said first DC voltage source is 1000 V and the predetermined magnitude of said second DC voltage source is between 460–470 V.

* * * * *